US007638722B2

(12) United States Patent
Iijima

(10) Patent No.: US 7,638,722 B2
(45) Date of Patent: Dec. 29, 2009

(54) OPERATING PIECE UNIT FOR SWITCH AND ELECTRONIC APPARATUS

(75) Inventor: Takashi Iijima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 152 days.

(21) Appl. No.: 11/703,233

(22) Filed: Feb. 7, 2007

(65) Prior Publication Data

US 2008/0060929 A1 Mar. 13, 2008

(30) Foreign Application Priority Data

Sep. 13, 2006 (JP) ..... 2006-247609

(51) Int. Cl.
*H01H 1/64* (2006.01)

(52) U.S. Cl. ..... 200/293; 200/296; 200/547; 200/252

(58) Field of Classification Search ..... 200/293, 200/296, 252, 547, 536
See application file for complete search history.

(56) References Cited

U.S. PATENT DOCUMENTS 5,969,309 A * 10/1999 Nishimura et al. ..... 200/16 C
5,990,425 A * 11/1999 McSwiggen ..... 200/16 R
6,204,461 B1 * 3/2001 Bucher et al. ..... 200/330
6,459,250 B1 * 10/2002 Davis ..... 323/352
6,989,504 B1 * 1/2006 Wu ..... 200/547
7,012,205 B1 * 3/2006 Han ..... 200/252

FOREIGN PATENT DOCUMENTS

| | | |
|---|---|---|
| JP | 10-154428 | 6/1998 |
| JP | 2001-325844 | 11/2001 |
| JP | 2004-63109 | 2/2004 |
| JP | 2006-179395 | 7/2006 |

* cited by examiner

*Primary Examiner*—Kyung Lee
(74) *Attorney, Agent, or Firm*—Fujitsu Patent Center

(57) ABSTRACT

A switch element is enclosed in the enclosure. The switch element includes a movable piece designed to move along a straight line between a switch-on position and a switch-off position. An operating piece is located along the outer surface of the enclosure. A connecting piece is located along the inner surface of the enclosure. The connecting piece is connected to the movable piece of the switch element. A sliding piece extends around the edge of the enclosure to connect one end of the operating piece to one end of the connecting piece. The sliding piece is designed to slide on the edge of the enclosure. The movable piece of the switch element moves between the switch-on position and the switch-off position in response to the movement of the operating piece.

8 Claims, 6 Drawing Sheets

OPERATING PIECE UNIT FOR SWITCH AND ELECTRONIC APPARATUS

BACKGROUND OF THE INVENTION

1. Field of the Invention

The present invention relates to an electronic apparatus such as a notebook personal computer.

2. Description of the Prior Art

A switch is incorporated in a notebook personal computer as disclosed in Japanese Patent Application Publication No. 10-154428, for example. The switch includes an operating piece attached to the side surface of the enclosure of the notebook personal computer for relative sliding movement. The operating piece is connected to a switch element located in the enclosure through a connecting piece. The connecting piece penetrates through a through hole defined in the wall of the enclosure. The switch element moves between an switch-on position and an switch-off position through the sliding movement of the operating piece.

The connecting piece is inserted in the through hole during the assembly of the notebook personal computer. A protrusion and/or a rib are formed on the connecting piece. The protrusion and/or the rib interrupt the insertion of the connecting piece into the through hole. This results in a deteriorated efficiency of the assembly.

SUMMARY OF THE INVENTION

It is accordingly an object of the present invention to provide an operating piece and an electronic apparatus contributing to a simplified assembly.

According to a first aspect of the present invention, there is provided an electronic apparatus comprising: an enclosure; a switch element enclosed in the enclosure, the switch element including a movable piece designed to move along a straight line between a switch-on position and a switch-off position; an operating piece located along the outer surface of the enclosure; a connecting piece located along the inner surface of the enclosure, the connecting piece connected to the movable piece of the switch element; and a sliding piece extending around the edge of the enclosure to connect one end of the operating piece and one end of the connecting piece to each other, the sliding piece designed to slide on the edge of the enclosure.

The electronic apparatus allows the sliding piece to extend around the edge of the enclosure to connect one end of the operating piece to one end of the connecting piece. The sliding piece is designed to slide on the edge of the enclosure. When the operating piece moves along the outer surface of the enclosure, the connecting piece similarly moves in response to the sliding movement of the sliding piece. The movable piece of the switch element moves between the switch-on position and the switch-off position in response to the movement of the operating piece.

The sliding piece is received on the edge of the enclosure for the assembly of the electronic apparatus. The operating piece is located along the outer surface of the enclosure. The connecting piece is simultaneously located along the inner surface of the enclosure. The connecting piece is connected to the movable piece of the switch element. While the sliding piece is received on the edge of the enclosure, the connecting piece is simultaneously connected to the switch element. Assembly of the electronic apparatus can be simplified.

The enclosure of the electronic apparatus may comprise: a base defining the edge; and a cover coupled to the base, the edge of the cover enabling interposal of the sliding piece between the edge of the cover and the edge of the base. Since the sliding piece is interposed between the base and the cover, it is unnecessary to define an opening in the base. This results in a simplified assembly of the electronic apparatus. In this case, the sliding piece may define a protrusion urged against the edge of the cover. The protrusion enables a reduction in the contact area between the sliding piece and the edge of the cover. This results in a reduction in the frictional force between the sliding piece and the edge of the cover.

According to a second aspect of the present invention, there is provided an operating piece unit for a switch, comprising: an operating piece; a connecting piece opposed to the operating piece at a predetermined interval; and a sliding piece extending around a space defined between the operating piece and the connecting piece, the sliding piece connecting the upper end of the operating piece and the upper end of the connecting piece to each other, the sliding piece defining a sliding surface extending on an imaginary line extending in contact with the space.

This operating piece unit is incorporated in an electronic apparatus, for example. The sliding surface of the sliding piece is received on the edge of the enclosure, for example. While the sliding piece is received on the edge of the enclosure, the connecting piece is connected to a switch element in the same manner as described above. The operating piece unit significantly contributes to a simplified assembly of the electronic apparatus, for example.

According to a third aspect of the present invention, there is provided a switch comprising: an operating piece; a connecting piece opposed to the operating piece at a predetermined interval; a sliding piece extending around a space defined between the operating piece and the connecting piece, the sliding piece connecting the upper end of the operating piece and the upper end of the connecting piece to each other, the sliding piece defining a sliding surface extending on an imaginary line extending in contact with the space; and a switch element including a movable piece connected to the sliding piece. The switch significantly contributes to a simplified assembly of an electronic apparatus, for example.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
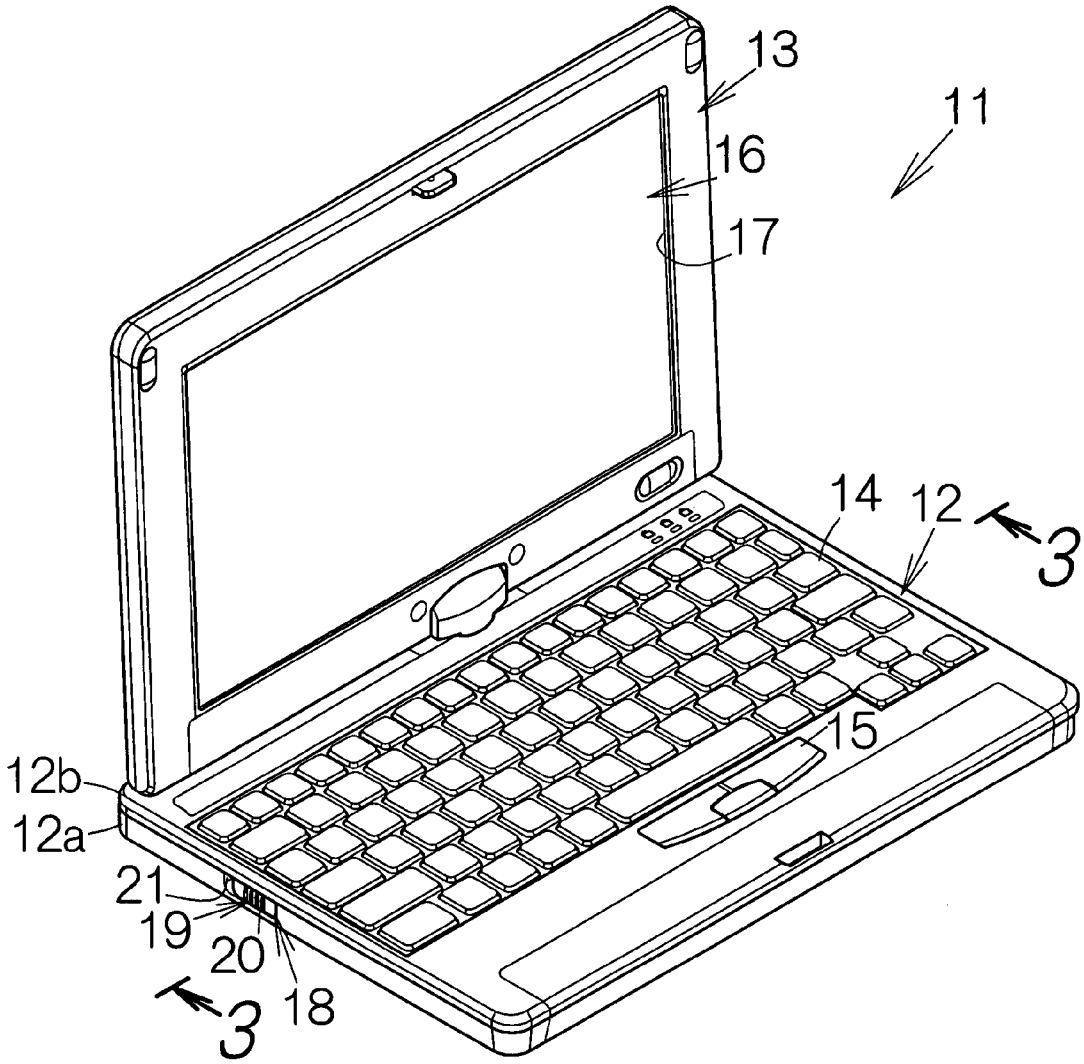
FIG. 1 is a perspective view schematically illustrating a notebook personal computer as a specific example of an electronic apparatus according to the present invention.

FIG. 1 schematically illustrates a notebook personal computer 11 as a specific example of an electronic apparatus according to the present invention. The notebook personal computer 11 includes a thin first enclosure, namely a main body enclosure 12, and a second enclosure, namely a display enclosure 13. The display enclosure 13 is coupled to the main body enclosure 12 for a relative swinging movement. The main body enclosure 12 includes a base 12*a* and a cover 12*b* removably coupled to the base 12*a*. Input devices such as a keyboard 114 and a pointing device 15 are embedded in the surface of the cover 12*b*. Users manipulate the keyboard 14 and/or the pointing device 15 to input commands and/or data.

A liquid crystal display (LCD) panel module 16 is enclosed in the display enclosure 13, for example. The screen of the LCD panel module 16 exposes within a window opening 17 defined in the display enclosure 13. Texts and graphics appear on the screen. Users can see the ongoing operation of the notebook personal computer 11 based on the texts and graphics on the screen. The display enclosure 13 can be superposed on the main body enclosure 12 through the pivotal movement relative to the main body enclosure 12.

An on-off switch 18 is incorporated in the surrounding wall of the main body enclosure 12. The on-off switch 18 includes an operating piece unit, namely an operating member 19. The operating member 19 is exposed on the outer surface of the main body enclosure 12. The operating member 19 defines an operating piece 20. The operating piece 20 is received in the depression 21 defined in the main body enclosure 12. The edge of the cover 12*b* serves to define a part of the contour of the depression 21. The operating piece 20 can slide in the depression 21 along the edge of the cover 12*b*. The operating piece 20 moves in this manner along a straight line between a switching-on position and a switching-off position.

Figure 2:
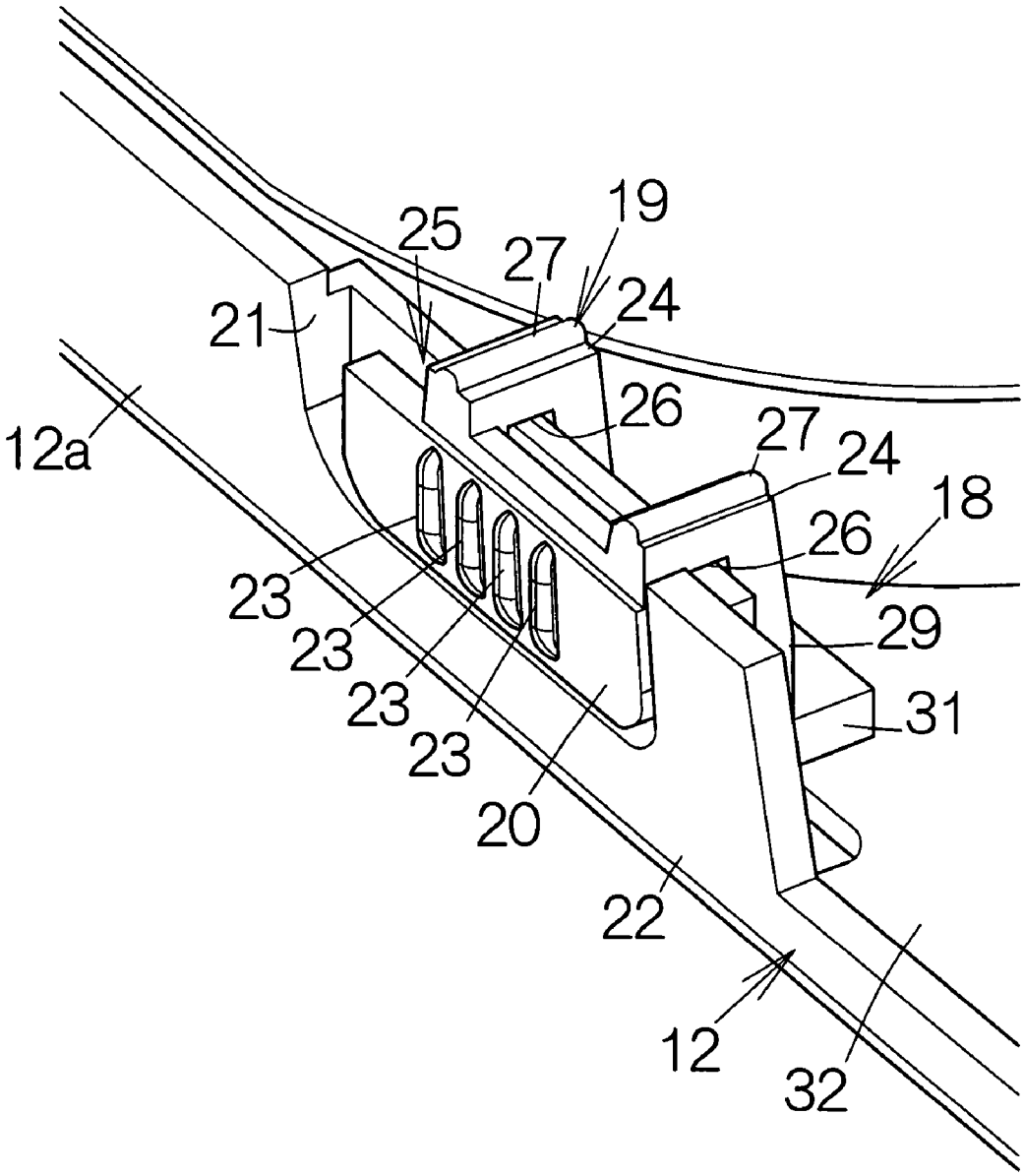
FIG. 2 is an enlarged partial perspective view schematically illustrating an operating piece unit.

As is apparent from FIG. 2, the operating piece 20 is located along the outer surface of a surrounding wall 22 defined in the base 12*a*. Swellings 23 are formed on the operating piece 20. The swellings 23 are designed to extend in a direction intersecting the direction of the movement of the operating piece 20. The swellings 23 may be arranged at regular intervals, for example. The swellings 23 serve to prevent the finger of the user from slipping off the operating piece 19. This results in a reliable sliding movement of the operating member 19.

A pair of sliding pieces 24, 24 is connected to the operating piece 20. One end of the individual sliding piece 24 is connected to the upper end of the operating piece 20. A predetermined space 25 is defined behind the operating piece 20. The surrounding wall 22 is located in the space 25. The individual sliding piece 24 is received on the upper end of the surrounding wall 22 at a sliding surface 26. The upper end of the surrounding wall 22 defines a flat surface extending on a straight line. The sliding surface 26 extends in contact with the flat surface. The sliding piece 24 can thus slide on the upper end of the surrounding wall 22. The sliding piece 24 extends around the space 25, namely the surrounding wall 22. The pair of sliding pieces 24 may extend in parallel with each other.

A protrusion 27 in the shape of a semi column is formed on the individual sliding piece 24. The protrusion 27 protrudes from the upper surface of the sliding piece 24. The protrusion 27 is designed to extend in a direction intersecting with the direction of the movement of the sliding piece 24. As is apparent from FIG. 3, the protrusion 27 is urged against the edge 28 of the cover 12*b*. The sliding piece 24 is interposed between the base 12*a* and the cover 12*b* for a relative sliding movement in this manner. The protrusion 27 enables a reduction in the contact area between the sliding piece 24 and the cover 12*b*. This results in a reduction in the frictional force between the sliding piece 24 and the cover 12*b*.

Figure 4:
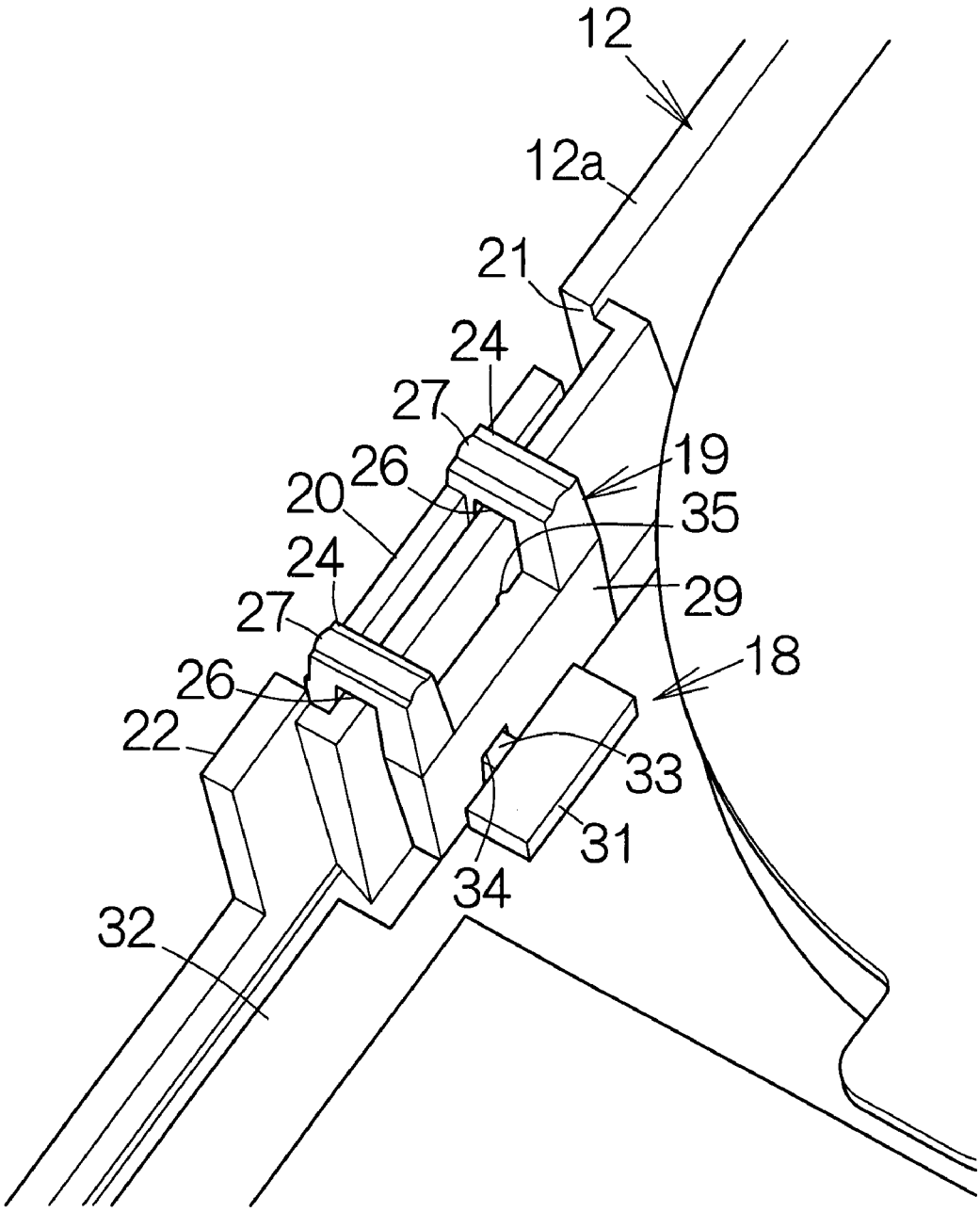
FIG. 4 is an enlarged partial perspective view schematically illustrating the operating piece unit.

Referring also to FIG. 4, a connecting piece 29 is defined in the operating member 19. The connecting piece 29 is opposed to the operating piece 20 across the aforementioned space 25. Specifically, the connecting piece 29 is located along the inner surface of the surrounding wall 22. The other end of the individual sliding piece 24 is connected to thee upper end of the connecting piece 29. The operating piece 20, the sliding piece 24 and the connecting piece 19 may be formed as a one-piece component. The one-piece component may be made of a resin material, for example.

A switch element 31 is located inside the surrounding wall 22. The switch element 31 is mounted on the surface of a printed wiring board 32. The printed wiring board 32 is enclosed in the main body enclosure 12. The switch element 31 includes a movable piece 33 designed to move along a straight line between a switch-on position and a switch-off position. The direction of the movement of the movable piece 33 coincides with that of the operating piece 20. When the movable piece 33 is set at the switch-on position, the switch element 31 enables the supply of electric current to a circuit. When the movable piece 33 is set at the switch-off position, the switch element 31 enables the cutoff of the electric current to the circuit.

A recess 34 is formed in the connecting piece 29. The movable piece 33 is engaged with the recess 34. The sliding movement of the operating piece 20 in this manner causes the movement of the movable piece 33 of the switch element 31. When the operating piece 20 is positioned at the switching-on position, the movable piece 33 reaches the switch-on position. When the operating piece 20 is positioned at the switching-off position, the movable piece 33 reaches the switch-off position.

Figure 5:
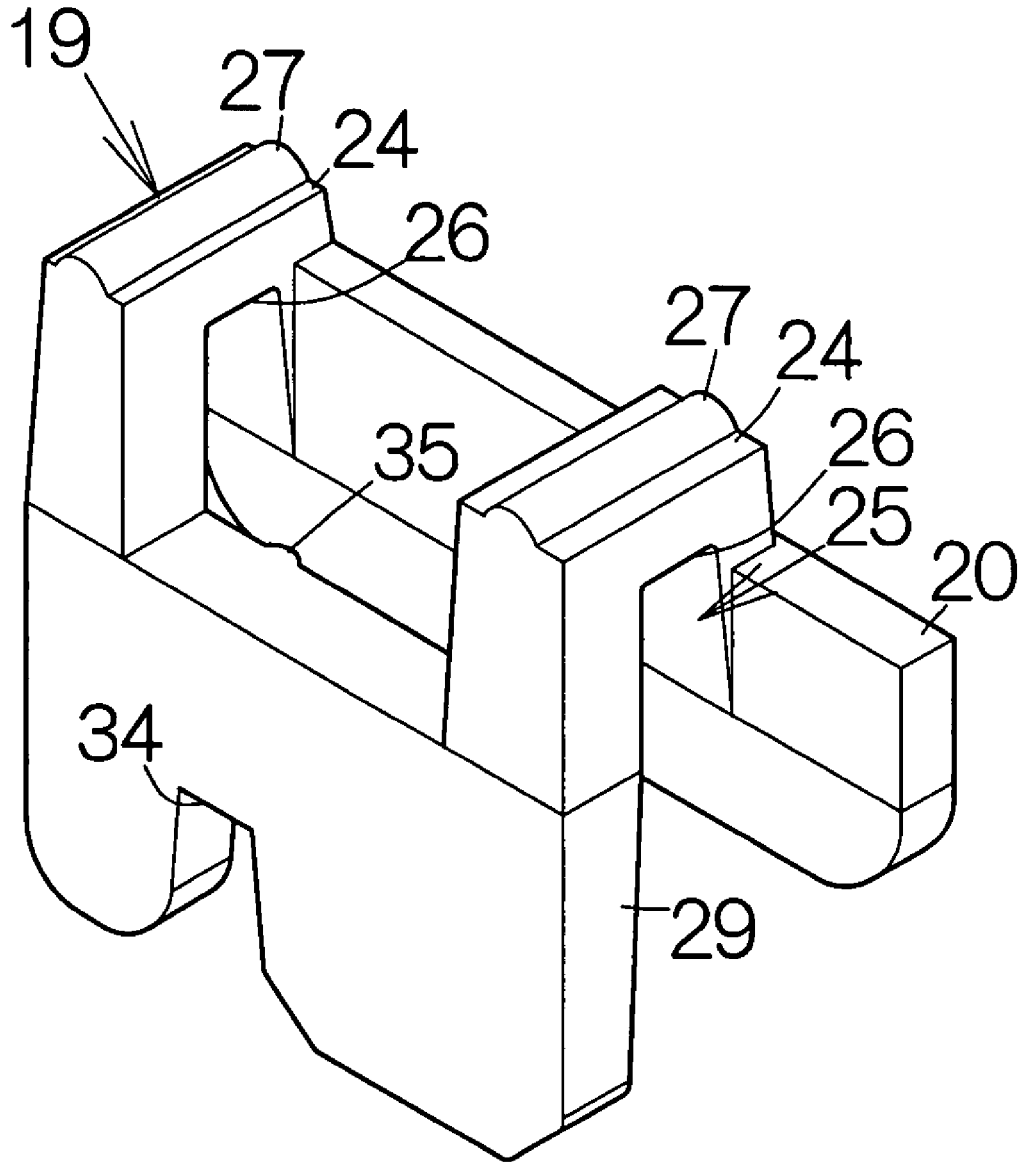
FIG. 5 is a perspective view schematically illustrating the operating piece unit.

As shown in FIG. 5, a small protrusion 35 in the shape of a semi column is defined on the inner surface of the connecting piece 29. The small protrusion 35 is designed to extend in a direction intersecting with the direction of the movement of the connecting piece 29. The connecting piece 29 is received on the inner surface of the surrounding wall 22 at the small protrusion 35. The small protrusion 35 enables a reduction in the contact area between the connecting piece 29 and the surrounding wall 22. This results in a reduction in the frictional force between the connecting piece 29 and the surrounding wall 22.

Figure 3:
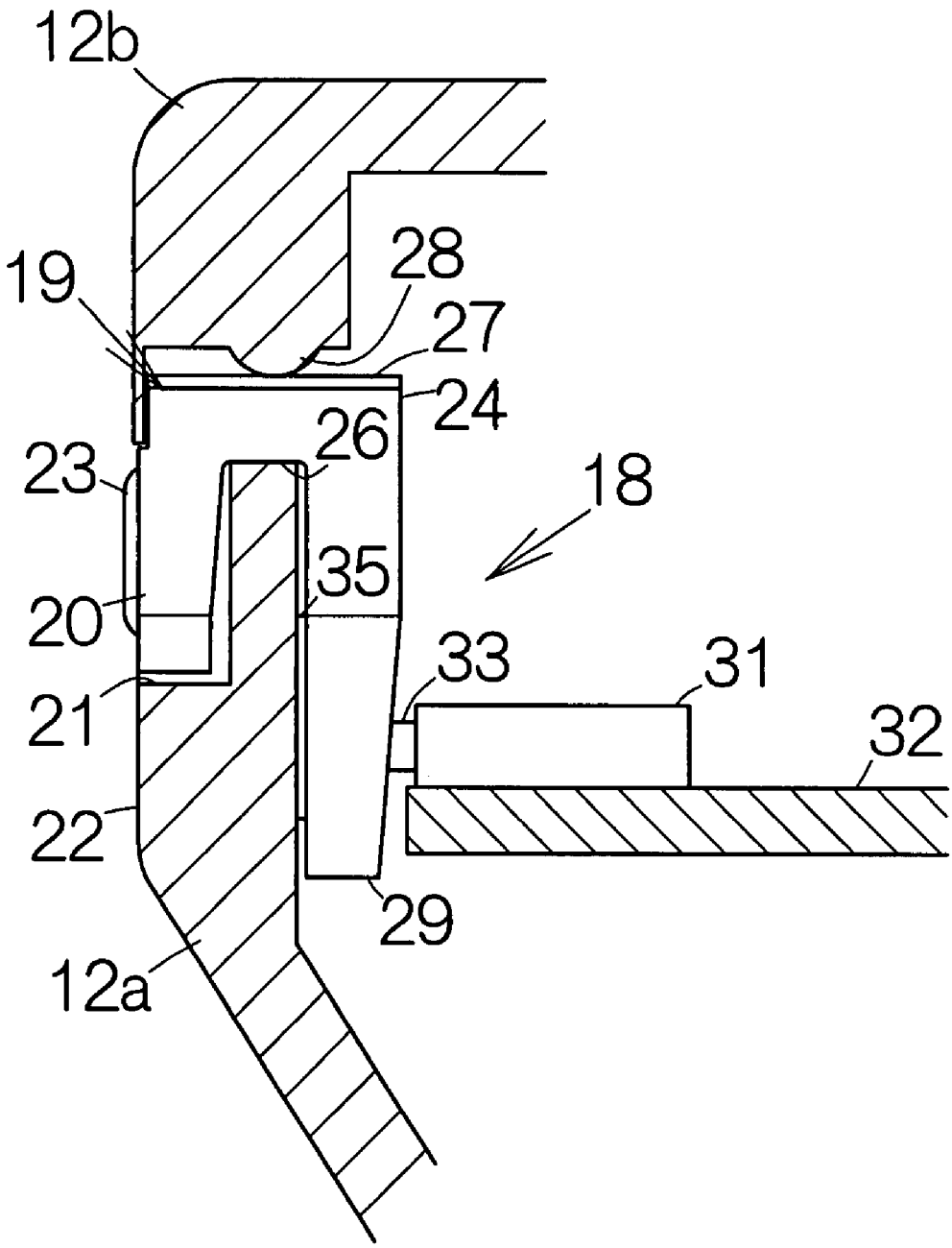
FIG. 3 is a sectional view taken along the line 3-3 in FIG. 1.
Figure 6:
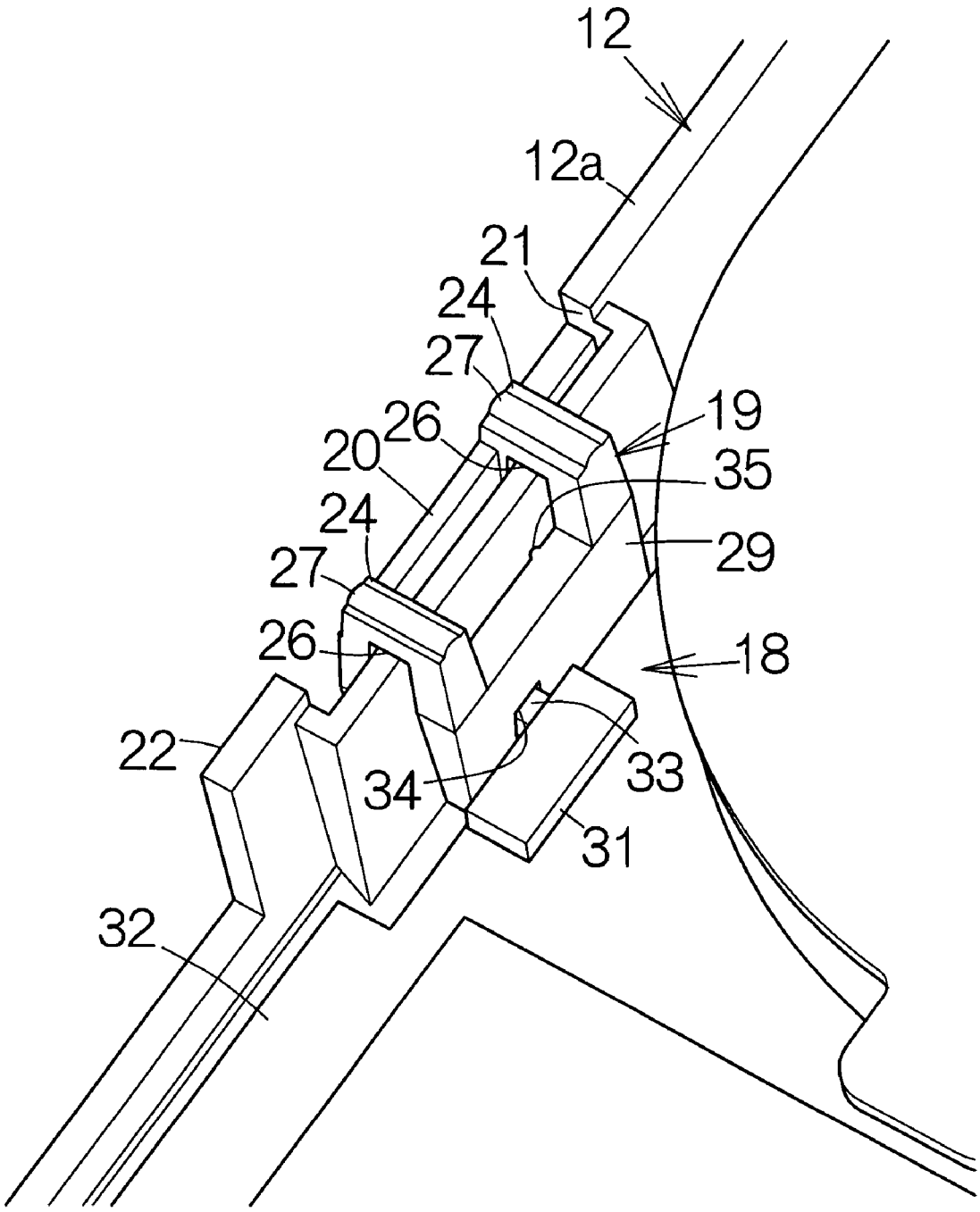
FIG. 6 is an enlarged partial perspective view schematically illustrating the operating piece unit.

When the movable piece 33 is set at the switch-on position as shown in FIG. 3, the notebook personal computer 11 allows establishment of radio communication, for example. When the operating piece 20 is positioned at the other end of the recess 21 through the sliding movement of the operating member 19, the movable piece 33 reaches the switch-off position as shown in FIG. 6. In this case, the notebook personal computer 11 allows establishment of wired communication, for example. The sliding movement of the operating member 19 in this manner realizes switchover between radio communication and wired communication.

Assume that the operating member 19 is to be attached to the base 12*a*. The pair of sliding pieces 24, 24 is first received on the edge of the base 12*a* prior to the coupling of the cover 12*b* with the base 12*a*. Simultaneously, the operating piece 20 is received in the depression 21. The movable piece 33 of the switch element 31 is received in the recess 34 of the connecting piece 29. Attachment of the operating member 19 to the edge of the base 12*a* enables a parallel establishment of the connection between the connecting piece 29 and the switch element 31 in this manner. Assembly of the notebook personal computer 11 can be simplified. The cover 12*b* is then coupled to the base 12*a*.

The operating member 19 may be incorporated in an electronic apparatus, such as a personal digital assistant (PDA), a cellular phone unit or a display device, or an input device such as a keyboard, in place of the aforementioned notebook personal computer 11.

What is claimed is:

1. An electronic apparatus comprising:

an enclosure including a base and a cover;

a switch element enclosed in the enclosure, the switch element including a movable piece configured to move along a straight line between a switch-on position and a switch-off position;

an operating piece located along an outer surface of the enclosure;

a connecting piece located along an inner surface of the enclosure, the connecting piece connected to the movable piece of the switch element; and a sliding piece slidably mounted around an edge of at least one of the base and the cover without being inserted through a hole of the at least one of the base and the cover, the sliding piece connecting one end of the operating piece and one end of the connecting piece to each other, wherein the connecting piece has an other end defining a recess for receiving the movable piece of the switch element.

2. The electronic apparatus according to claim 1, wherein the base defines the edge, and the cover is coupled to the base and defines an edge opposed to the edge of the base, the edge of the cover enabling insertion of the sliding piece between the edge of the cover and the edge of the base.

3. The electronic apparatus according to claim 2, wherein the sliding piece defines a protrusion urged against the edge of the cover.

4. The electronic apparatus according to claim 1, wherein the base has the edge, which provides a sliding surface, and the cover includes a contacting surface directly facing the sliding surface of the base.

5. The electronic apparatus according to claim 1, wherein a plane of a portion of the sliding piece extending inside the enclosure is displaced from a parallel plane passing through the movable piece.

6. The electronic apparatus according to claim 1, wherein a primary axis of the connecting piece is substantially parallel to an adjacent inner surface of the enclosure.

7. An electronic apparatus comprising:

an enclosure including a base and a cover;

a switch element enclosed in the enclosure, the switch element including a movable piece configured to move along a straight line between a switch-on position and a switch-off position;

an operating piece located along an outer surface of the enclosure;

a connecting piece located along an inner surface of the enclosure, the connecting piece connected to the movable piece of the switch element; and a sliding piece slidably mounted around an edge of at least one of the base and the cover without being inserted through a hole of the at least one of the base and the cover, the sliding piece connecting one end of the operating piece and one end of the connecting piece to each other, wherein the base defines the edge, and the cover is coupled to the base and defines an edge opposed to the edge of the base, the edge of the cover enabling insertion of the sliding piece between the edge of the cover and the edge of the base, and wherein the sliding piece defines a protrusion urged against the edge of the cover.

8. An electronic apparatus comprising:

an enclosure including a base and a cover;

a switch element enclosed in the enclosure, the switch element including a movable piece configured to move along a straight line between a switch-on position and a switch-off position;

an operating piece located along an outer surface of the enclosure;

a connecting piece located along an inner surface of the enclosure, the connecting piece connected to the movable piece of the switch element; and a sliding piece slidably mounted around an edge of at least one of the base and the cover without being inserted through a hole of the at least one of the base and the cover, the sliding piece connecting one end of the operating piece and one end of the connecting piece to each other, wherein a plane of a portion of the sliding piece extending inside the enclosure is displaced from a parallel plane passing through the movable piece.

* * * * *